US009394700B1

(12) United States Patent
Rodriguez

(10) Patent No.: US 9,394,700 B1
(45) Date of Patent: Jul. 19, 2016

(54) DATA CENTER FLOOR MANAGEMENT

(71) Applicant: INTERNATIONAL BUSINESS MACHINES CORPORATION, Armonk, NY (US)

(72) Inventor: Jean-Michel Rodriguez, Montpellier (FR)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 14/791,693

(22) Filed: Jul. 6, 2015

(51) Int. Cl.
*E04F 15/024* (2006.01)
*E04F 15/02* (2006.01)

(52) U.S. Cl.
CPC ..... *E04F 15/02417* (2013.01); *E04F 15/02177* (2013.01); *E04F 15/02447* (2013.01); *E04F 2290/02* (2013.01)

(58) Field of Classification Search
CPC . H02G 3/285; E04F 15/024; E04F 15/02417; E04F 15/02405; E04F 15/02411; E04F 15/02447; E04F 2290/02; E04F 15/02177; F24F 13/068; F24F 111/40
USPC ..... 52/263, 792.1, 792.11; 174/482
See application file for complete search history.

(56) References Cited

U.S. PATENT DOCUMENTS 2,930,504 A * 3/1960 Hudson ..... H02G 3/185 174/482
4,124,324 A * 11/1978 Augis ..... H02G 9/065 404/25
4,773,196 A * 9/1988 Yoshida ..... H02G 3/285 174/486
4,934,116 A * 6/1990 Frederiksen ..... H05F 3/025 52/220.3
5,263,289 A * 11/1993 Boyd ..... E04F 15/024 52/220.2
5,467,609 A * 11/1995 Feeney ..... E04F 15/02411 52/220.2
5,613,339 A * 3/1997 Pollock ..... B63B 3/48 114/263
5,735,097 A * 4/1998 Cheyne ..... B63B 5/06 114/263
5,881,508 A * 3/1999 Irvine ..... E01C 5/20 405/219
6,526,710 B1 * 3/2003 Killen ..... E04F 15/10 52/105
6,584,914 B1 * 7/2003 Koefelda ..... B65D 19/0012 108/54.1
6,598,366 B2 * 7/2003 Hsieh ..... H02G 3/285 52/220.3
7,490,443 B1 * 2/2009 Lovald ..... E01C 9/086 52/220.2

(Continued)

FOREIGN PATENT DOCUMENTS

JP 05118124 A * 5/1993
NL WO 9201130 A1 * 1/1992 ..... E04F 15/02411

OTHER PUBLICATIONS

Rodriguez, Jean-Michel, "Data Center Floor Management", U.S. Appl. No. 14/926,041, filed Oct. 29, 2015 (26 pages).

(Continued)

*Primary Examiner* — Robert Canfield
(74) *Attorney, Agent, or Firm* — Steven Chiu, Esq.; Kevin P. Radigan, Esq.; Heslin Rothenberg Farley & Mesiti P.C.

(57) ABSTRACT

A floor tile for a data center floor is provided that includes a first tile module having a main surface including a first side wall portion and a second side wall portion extending from opposite edges of the main surface, the first side wall portion and second side wall portion each including at least one recess for receiving cabling; and a second tile module having a main further surface adapted to form a removable lid of the first tile module. A data center floor including such a floor tile and a data center including such a data center floor are also provided.

12 Claims, 5 Drawing Sheets

(56) References Cited

U.S. PATENT DOCUMENTS

| | | | | |
|---|---|---|---|---|
| 8,051,613 | B2 * | 11/2011 | Lu | E04C 2/324 52/220.1 |
| 8,464,490 | B2 * | 6/2013 | Rapaz | E04C 2/20 428/133 |
| 8,770,115 | B2 * | 7/2014 | Apps | B65D 19/0004 108/57.25 |
| 9,230,227 | B2 * | 1/2016 | Muirhead | B65D 19/0016 |
| 2007/0017180 | A1 * | 1/2007 | Ting | E04F 15/02476 52/792.11 |
| 2009/0183450 | A1 * | 7/2009 | Lu | E04B 1/0023 52/220.1 |
| 2010/0300026 | A1 * | 12/2010 | Candiracci | E04B 2/847 52/309.4 |

OTHER PUBLICATIONS

Rodriguez, Jean-Michel, "Listing of IBM Patents and Patent Application Treated as Related", U.S. Appl. No. 14/791,693, filed Jul. 6, 2015, dated Mar. 8, 2016 (2 pages).

* cited by examiner

DATA CENTER FLOOR MANAGEMENT

BACKGROUND

One or more aspect of the present invention relate to floor tiles for a data center floor.

Data centers are large computer rooms in which a large number of servers are organized. Consequently, a large amount of heat is generated by the servers in operation, which requires effective cooling of the servers in the data centers to ensure that the servers operate within acceptable thermal parameters, e.g. below a critical operating temperature.

In order to achieve such effective cooling, the data center may be organized in so-called hot aisles and cold aisles. Server racks may separate the hot aisles from the cold aisles, with the servers in the server racks typically arranged to draw cold air from the cold aisles to cool the servers in the racks and expel the heated air into the hot aisles. A computer room air conditioning (CRAC) unit draws in air from the hot aisles, typically through ceiling tiles of the computer room and returns the cooled air to the cold aisles.

In order to facilitate the return of the cooled air by the CRAC unit, the data centers are usually provided with a modular floor that is raised above the floor of the data center, such that the cold air flow can be fed into the clearing underneath the elevated modular floor and fed into the cold aisles through openings in the raised floor. For example, the raised floor may comprise at least some floor tiles that have air gaps, e.g. perforations and/or grates. The modular floor typically comprises a grid of floor tiles, wherein the floor tiles in the cold aisles for instance may contain the air gaps to allow cold air to be fed into the cold aisles.

Cable management in such data centers is typically provided under the elevated modular floor. For example, U.S. Pat. No. 8,716,602 B2 discloses cable grommets for use with raised floor tiles and EP 2 136 447 A1 discloses a cable management system for managing electrical cables in a raised floor grid system.

A particular challenge in such data centers is maintenance or repairs in which access to the electrical or network cables underneath the elevated modular floor is required. This typically requires the removal of a floor tile to provide access to the cables, which has the drawback of altering the air flow through the elevated modular floor, thereby potentially compromising the temperature control in the data center. In addition, such removed floor tiles cause health and safety concerns as people operating in the data center may fall through the hole created by the removal of the floor tile, thus causing risk of injury.

SUMMARY

The present invention seeks to provide a floor tile for a data center floor that facilitates maintenance to cabling without requiring the complete removal of the floor tile.

According to one or more aspects, there is provided herein a floor tile for a data center floor. The floor tile comprises, for instance, a first tile module having a main surface including a first side wall portion and a second side wall portion extending from opposite edges of the main surface, the first side wall portion and second side wall portion each comprising at least one recess for receiving cabling; and a second tile module having a main further surface adapted to form a removable lid of the first tile module.

Such a floor tile contains a first tile module for cable management and a removable second tile module that seals the first tile module and provides a load bearing support surface on which for instance maintenance personnel can walk. In case personnel need access to the cables of the data center, the second tile module may be removed to provide access to the cables in the first tile module without creating a through hole in the data center floor, thus improving thermal management and reducing the risk of injury in a data center including such a data center floor.

The first tile module of the floor tile may further comprise a third side wall portion opposite a fourth side wall portion, the third side wall portion and fourth side wall portion each extending from the first side wall portion to the second side wall portion to create a rim or lip surrounding the main surface. This, for instance, can improve the retention of cables within the floor tile.

The third side wall portion and the fourth side wall portion each may comprise at least one further recess for receiving cabling. This for instance allows for cables to run in multiple directions, e.g. in a grid-like fashion from the floor tile, which may facilitate more flexible cabling routing under the data center floor.

In an embodiment, the main further surface rests on the first side wall portion and the second side wall portion when the second tile module is placed on the first tile module.

The main further surface may comprise at least a first further side wall portion and a second further side wall portion opposite the first further side wall portion such that the first side wall portion faces the first further side wall portion and the second side wall portion faces the second further side wall portion when the second tile module is placed on the first tile module.

Alternatively, the first further side wall portion and the second further side wall portion rest on the main surface of the first tile module when the second tile module is placed on the first tile module or the first side wall portion and the second side wall portion rest on the main further surface of the second tile module when the second tile module is placed on the first tile module. In other words, the first tile module may sit inside the second tile module or vice versa, which facilitates placement of the second tile module on the first tile module.

The first further side wall portion and the second further side wall portion each may comprise at least one further recess arranged to cooperate with a recess of the first side wall portion or second side wall portion to form a cable opening for the cabling. This for instance may assist in aligning the first and second tile modules, as the recesses and further recesses can be used as alignment aids.

The floor tile may further comprise a fastening arrangement for fastening the first tile module to the second tile module. This, for instance, prevents accidental removal of the second tile module and consequential accidental exposure of the cables within the floor tile.

The main surface and the main further surface each may comprise a plurality of air holes for circulating air through the floor tile. Such floor tiles are suitable for use in a cold aisle, where cold air needs to be forced through the data center floor. For example, the main surface and the main further surface may be perforated surfaces.

According to another aspect, provided herein is a data center floor comprising a grid of floor tiles, including floor tiles having a first tile module having a main surface including a first side wall portion and a second side wall portion extending from opposite edges of the main surface, the first side wall portion and second side wall portion each comprising at least one recess for receiving cabling; and a second tile module having a main further surface adapted to form a removable lid of the first tile module. Such a data floor center benefits from easy access to the cable management without requiring the removal of a complete floor tile.

The data center floor may further comprise a plurality of legs for raising the grid of floor tiles above a floor surface on which the legs are to be positioned to facilitate air being forced underneath the data center floor.

According to yet another aspect, there is provided a data center including a data center floor comprising a grid of floor tiles including floor tiles having a first tile module having a main surface including a first side wall portion and a second side wall portion extending from opposite edges of the main surface, the first side wall portion and second side wall portion each comprising at least one recess for receiving cabling; and a second tile module having a main further surface adapted to form a removable lid of the first tile module. Such a data center can be maintained in a safe manner without affecting climate control as there is no need to remove a complete floor tile to gain access to the data center cables, as these cables are stored in the first tile module of the floor tiles.

The data center floor in the data center may further comprise a plurality of legs mounted on the grid of floor tiles, the legs raising the grid of floor tiles above a floor surface of the data center on which the legs are placed. This facilitates cold air being forced underneath the data center floor such that cold air can be circulated to the cold aisles of the data center, e.g. through floor tiles containing air gaps in the cold aisles.

BRIEF DESCRIPTION OF THE DRAWINGS

Various embodiments of the present invention are described below, by way of example only, with reference to the following drawings, in which.

DETAILED DESCRIPTION

Figure 1:
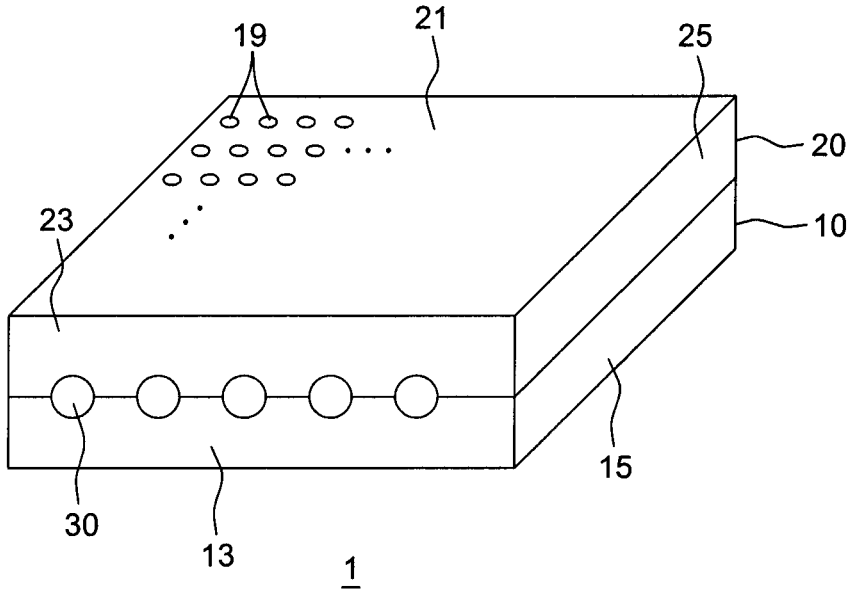
FIG. 1 schematically depicts a perspective view of one embodiment of a floor tile, according to one or more aspects of the present invention.

It should be understood that the Figures are merely schematic and are not drawn to scale. It should also be understood that the same reference numerals are used throughout the Figures to indicate the same or similar parts.

FIG. 1 schematically depicts a floor tile 1 for use in a data center floor according to one or more aspects of the present invention. The floor tile 1 includes a first tile module 10 and a second tile module 20 that cooperate to form the floor tile 1. The first tile module 10 may comprise opposing first and second wall portions 13 that define an edge or lip of the first tile module 10 by extending from a main or major surface of the first tile module 10. This major surface cannot be seen in FIG. 1. In FIG. 1, the first tile module 10 further comprises opposing third and fourth wall portions 15 that each extend between the first and second wall portions 13 and define a further edge or lip of the first tile module 10 by extending from the main or major surface of the first tile module 10, thereby defining a first tile module 10 that is more or less shaped as a tray.

The second tile module 20 comprises a main or major further surface 21 from which opposing first and second further wall portions 23 extend. In FIG. 1, the second tile module 10 further comprises opposing third and fourth further wall portions 25 that each extend between the first and second further wall portions 23 and define a further edge or lip of the second tile module 20 by extending from the main or major further surface of the second tile module 20, thereby defining a second tile module 20 that is more or less shaped as a tray or lid.

The second tile module 20 fits on the first tile module 10, for example by the first wall and second portions 13 engaging with the first and second further wall portions 23 and the third and fourth wall portions 15 engaging with the third and fourth further wall portions 25 such that the wall portions of the second tile module 20 rest on the wall portions of the first tile module 10 with which they engage. At least one pair of opposing portions includes a plurality of apertures 30 that allow cables such as network cables or power cables to run through the floor tile 1 in assembled form. In FIG. 1, the apertures 30 are delimited by a first wall portion 13 engaging with a first further wall portion 23 (apertures 30 are also present in the opposing wall of the floor tile 1, where the apertures are delimited by the second wall portion and second further wall portion) although it should be understood that it is equally feasible that the apertures 30 are delimited by a third and fourth wall portion 15 engaging with a third and fourth further wall portion 25 respectively. Although not explicitly shown, it should be understood that each aperture 30 may include a cable protection member, such as a plastics ring or the like that protects any cables running through the floor tile 1 from being damaged by potentially sharp edges on the wall portions delimiting the aperture 30.

The apertures 30 may have any suitable shape. A circular shape may be advantageous if the floor tile 1 is to receive cables having a circular cross-section, although it should be understood that the apertures 30 may have different shapes, for example, if different shaped cables such as flat cables for instance are used in addition or instead. In one or more embodiments, the floor tile 1 may contain apertures 30 having different shapes in order to cater for the use of differently shaped cables.

The floor tile 1 may have any suitable dimensions or shape, e.g., may have a square or oblong shape. The first and second wall portions 13, 15 may have the same height as the first and second further wall portions 23, 25 or may have a different height there to. Equal amounts of the circumference the apertures 30 may be delimited by the respective wall portions of the first tile module 10 and the second tile module 20 or the apertures 30 may be predominantly or solely delimited by one of the two modules. The latter is particularly suitable if the wall portions 13, 15 have a different height to the further wall portions 23, 25, in which case it may be more practical to have the apertures 30 predominantly or solely delimited by the tile module having the higher wall portions.

The floor tile 1 may be made of any suitable material capable of bearing the typical loads associated with data center floors. Metals, e.g. aluminium, or metal alloys, e.g. aluminium alloys, titanium alloys, steel, and so on, are non-limiting examples of such suitable materials. The first tile module 10 and the second tile module 20 may be made of the same material or may be made of different materials, although in the latter case it may be advantageous for the different materials have comparable thermal expansion coefficients in order to avoid warping or other types of deformation of the floor tile 1 caused by variations in temperature within a data center.

The first tile module 10 may be mounted as the bottom module of the floor tile 1 in a data center floor with the second tile module 20 forming the top module floor tile 1, such that the main or major further surface 21 acts as the exposed surface of the floor tile 1, e.g. the surface on which server racks are mounted, the surface that defines corridors in between server racks, and so on. The first tile module 10 may act as the cable management solution underneath the exposed surface of the floor tile 1, with the cables running through the apertures 30 of the floor tile 1 and resting on the main major surface of the first tile module 10.

The second tile module 20 is removably mounted on the first tile module 10 to allow access to the cables in the first tile module 10, e.g. for maintenance purposes. As will be understood, due to the fact that of the first tile module 10 does not require removal from a data center floor during such maintenance, airflow through the data center floor is not (significantly) affected by the removal of the second tile module 20 only and furthermore no fall through holes are created in a data center floor during such maintenance due to the fact that the first tile module 10 is retained in the data center floor.

The second tile module 20 may be secured on the first tile module 10 during normal use of the data center to avoid accidental removal of the second tile module 20 from the first tile module 10, which accidental removal would expose the cables supported by the first tile module 10, which may be undesirable and could cause potential hazards such as trip hazards. To this end, the floor tile 1 may include a fastening arrangement for fastening the first tile module 10 to the second tile module 20. Non-limiting examples of suitable fasting arrangements include clips, brackets, screws, bolts, and the like, although of course it will be immediately apparent to the skilled person that many other fastening arrangements are equally feasible.

The main surface of the first the module 10 and the main further surface 21 of the second tile module 20 may contain air gaps or holes 19 to allow air to pass through the floor tile 1. This for particularly advantageous if the floor tile 1 is to be fitted in a cold aisle of a data center, where cold air generated by an air conditioning unit may be fed underneath the data center floor and must pass this floor in order to achieve effective cooling of the servers on the data center floor. Such air gaps may take any suitable shape. For example, the main surface of the first tile module 10 and the main further surface 21 of the second tile module 20 may contain a regular pattern of air gaps, which for instance may be created by the surfaces comprising a grid or lattice work of surface strips or portions separated by clearances acting as the air gaps. Alternatively, the main surface of the first tile module 10 and the maim surface 21 of second tile module 20 may be perforated to create a pattern of air gaps, e.g. a regular pattern. The skilled person will have no problem to come up with equally suitable alternatives of creating air gaps in the main surface of the first tile module 10 and the main further surface 21 of the second tile module 20.

Figure 2:
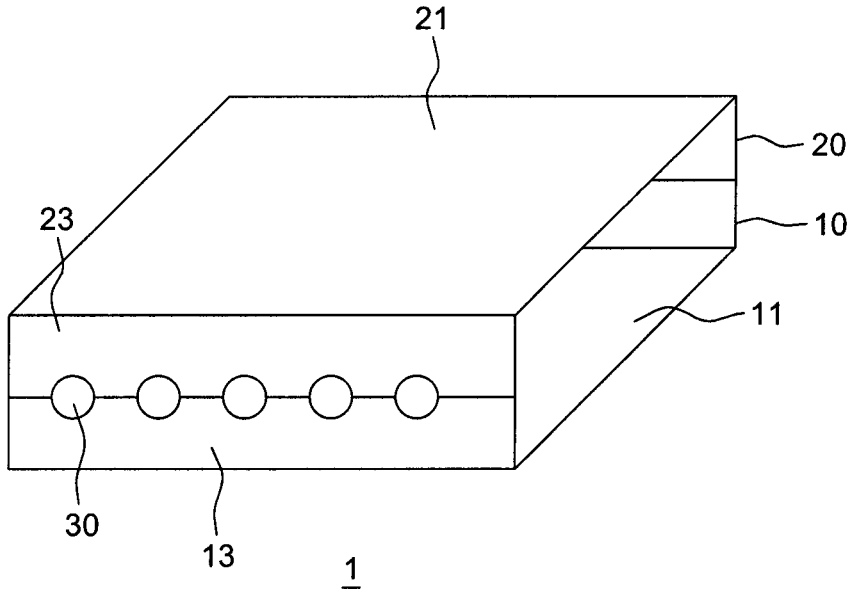
FIG. 2 schematically depicts a perspective view of another embodiment of a floor tile, according to one or more aspects of the present invention.

FIG. 2 schematically depicts an alternative embodiment of the floor tile 1 comprising a first tile module 10 and a second tile module 20. This embodiment differs from the embodiment shown in FIG. 1 in that the third and fourth wall portions 15 of the first tile module 10 and the third and fourth further wall portions 25 of the second tile module 20 have been omitted, such that the first tile module 10 comprises a first wall portion 13 extending from the main or major surface 11 of the first tile module 10 and a second wall portion 15 opposite the first wall portion 13 also extending from the main or major surface 11. Similarly, the second tile module 20 comprises a first further wall portion 23 extending from the main or major further surface 21 of the second tile module 20 and a second further wall portion 25 opposite the first further wall portion 23 also extending from the main or major further surface 21.

FIGS. 1 and 2 schematically depict embodiments in which the respective wall surfaces of the first tile module 10 and the second tile module 20 align (engage with each other) when the second tile module 20 is placed on the first tile module 10. This has the advantage that a floor tile 1 is provided that can be abutted against neighboring floor tiles in a data center floor in a particularly compact manner. However, it should be understood that alternative arrangements are also feasible.

Figure 3:
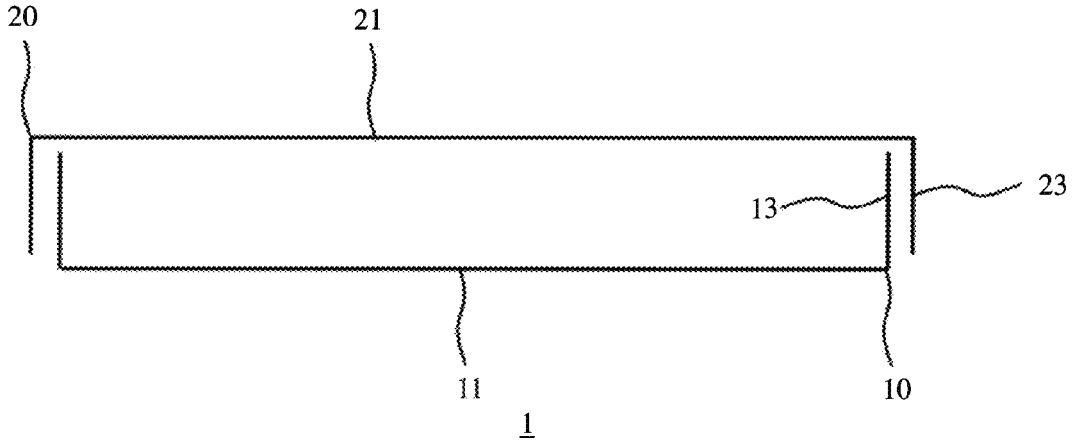
FIG. 3 schematically depicts a cross-sectional view of yet another embodiment of a floor tile, according to one or more aspects of the present invention.

An example of such an alternative arrangement is shown in FIG. 3, which schematically depicts a cross-section of a floor tile 1 according to yet another embodiment. The embodiment shown in FIG. 3 differs from the embodiments in FIGS. 1 and 2 in that the second tile module 20 is slightly larger in diameter than the first tile module 10 such that the side wall portions of the first tile module 10 are enclosed by the further side wall portions of the second tile module 20 when the second tile module 20 is placed on the first tile module 10. In this embodiment, the second tile module 20 is supported by the first tile module 10 by the main further surface 21 of the second tile module 20 resting on the side walls, e.g. first and second sidewalls 13 and third and fourth sidewalls 15 if present when the second tile module 20 is placed on the first tile module 10. This embodiment has the advantage that placement of the second tile module 20 on the first time module 10 is particularly straightforward as it requires little alignment effort.

Figure 4:
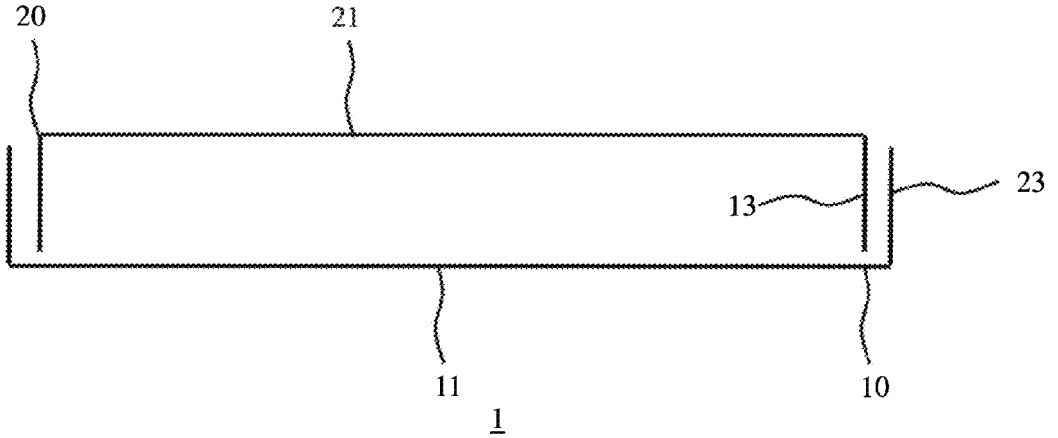
FIG. 4 schematically depicts a cross-sectional view of yet another embodiment of a floor tile, according to one or more aspects of the present invention.

Yet another example of such an alternative arrangement is shown in which schematically depicts a cross-section of a floor tile 1 according to yet another embodiment. The embodiment shown in FIG. 4 differs from the embodiments in FIGS. 1 and 2 in that the second tile module 20 is slightly smaller in diameter than the first tile module 10 such that the further side wall portions of the second tile module 20 are enclosed by the side wall portions of the first tile module 10 when the second tile module 20 is placed on the first tile module 10. In this embodiment, the second tile module 20 is supported by the first tile module 10 by the sidewalls of the second tile module 20, e.g. first and second further sidewalls 23 and third and fourth further sidewalls 25 if present, resting on the main or major surface 11 of the first tile module 10 when the second tile module 20 is placed on the first tile module 10. This embodiment also has the advantage that placement of the second tile module 20 on the first time module 10 is particularly straightforward as it requires little alignment effort but this less preferable than the embodiment shown in FIG. 3 as this configuration exposes gaps between floor tiles 1 in a data center floor, which, if undesirable, may require additional measures such as applying sealing members, e.g. rubber or plastic sealing strips, in between abutting floor tiles 1, which may make data center floor maintenance more cumbersome as such sealing members may need to be removed temporarily to facilitate disassembling a floor tile 1.

Figure 5:
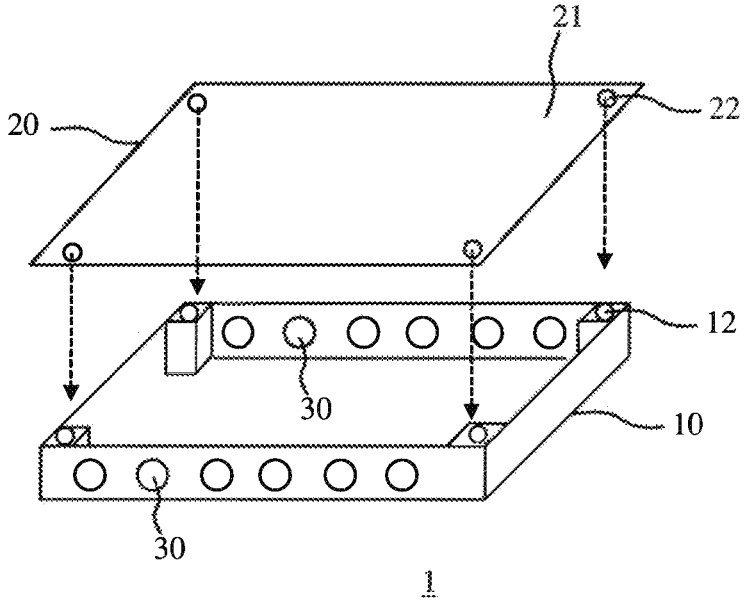
FIG. 5 schematically depicts a perspective view of yet another embodiment of a floor tile, according to one or more aspects of the present invention.

In the embodiments schematically depicted in FIG. 1-4, the second tile module 20 comprises side walls 21, 22 and optionally 23, 24 that engage with part of the first tile module 10 when the second tile module 20 is placed on or over the first tile module 10 as previously explained. FIG. 5 schematically depicts an alternative embodiment in which the second tile module 20 simply comprises a plate or lid without sidewalls for placement on the first tile module 10. In order for the second tile module 20 to sit flush within the first tile module 10, the first tile module 10 may comprise a support structure within the volume delimited by the first and second sidewalls 13 and the third and fourth sidewalls 15, such as support posts 12 or a support lip or ridge extending along each of these sidewalls. The support structures are typically recessed relative to the upper edge of the sidewalls such that when the second tile module 20 is placed on the support structure of the first tile module 10, the second tile module 20 sits flush with the upper edges of the sidewalls 11-14 of the first tile module 10.

As previously explained, the second tile module 20 may be secured on the first tile module 10 using any suitable fasting arrangement. By way of non-limiting example, FIG. 5 schematically depicts screw holes 22 in the main further surface 21 of the second tile module 20 for receiving screws, which screw holes 22 line with respective threads formed in the support structure of the first tile module 10 such that the second tile module 20 may be screwed against the first tile module 10. As mentioned above, other fasting arrangements are equally feasible and may also be contemplated.

As will be readily understood, due to the fact that the second tile module 20 does not have sidewalls extending from the main further surface 21, the apertures 30 in this embodiment are entirely delimited by the first and second wall portions 13 of the first tile module 10.

Figure 6:
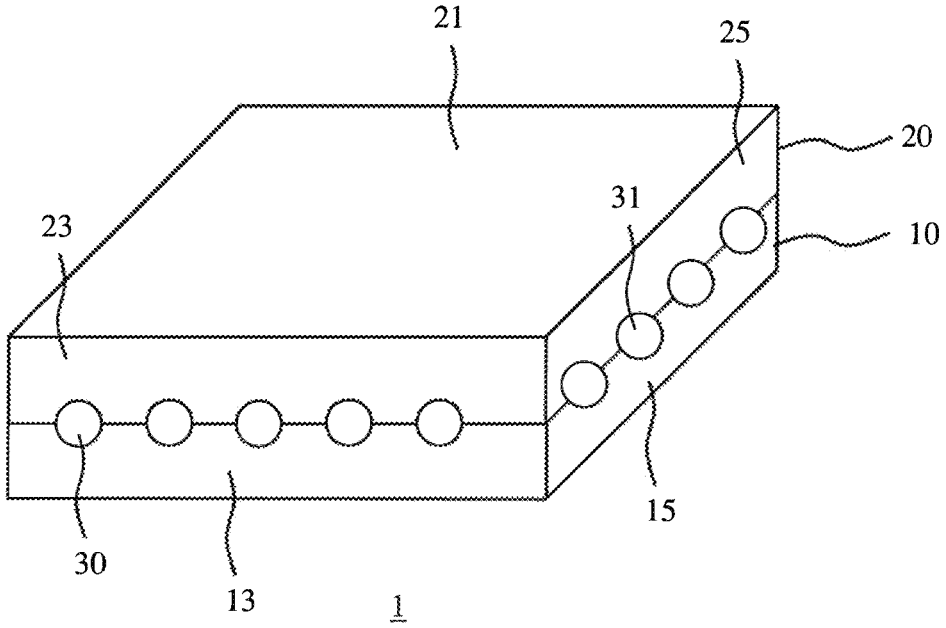
FIG. 6 schematically depicts a perspective view of yet another embodiment of a floor tile, according to one or more aspects of the present invention.

In the embodiments depicted in FIGS. 1-5, the floor tiles 1 have apertures 30 in the opposing first and second wall portions of the first tile module 10 (and opposing first and second further wall portions of the second tile module 20 where applicable) to facilitate cables running through the floor tile 1 in a single direction, for instance along a cold or hot aisle of a data center. However, in some embodiments it may be desirable to have cables running in multiple directions in a data center, for instance along and across such aisles. In such embodiments, a floor tile 1 according to an embodiment as schematically depicted in FIG. 6 may be used in which further apertures 31 may be defined by the opposing third and fourth wall portions 15 of the first tile module 10 and optionally by the opposing third and fourth further wall portions 25 of the second tile module 20. As before, the edges of the further apertures 31 may be protected by a cable protection member, such as a plastics ring or the like that protects any cables running through the floor tile 1 from being damaged by potentially sharp edges on the wall portions delimiting the further aperture 31.

Figure 7:
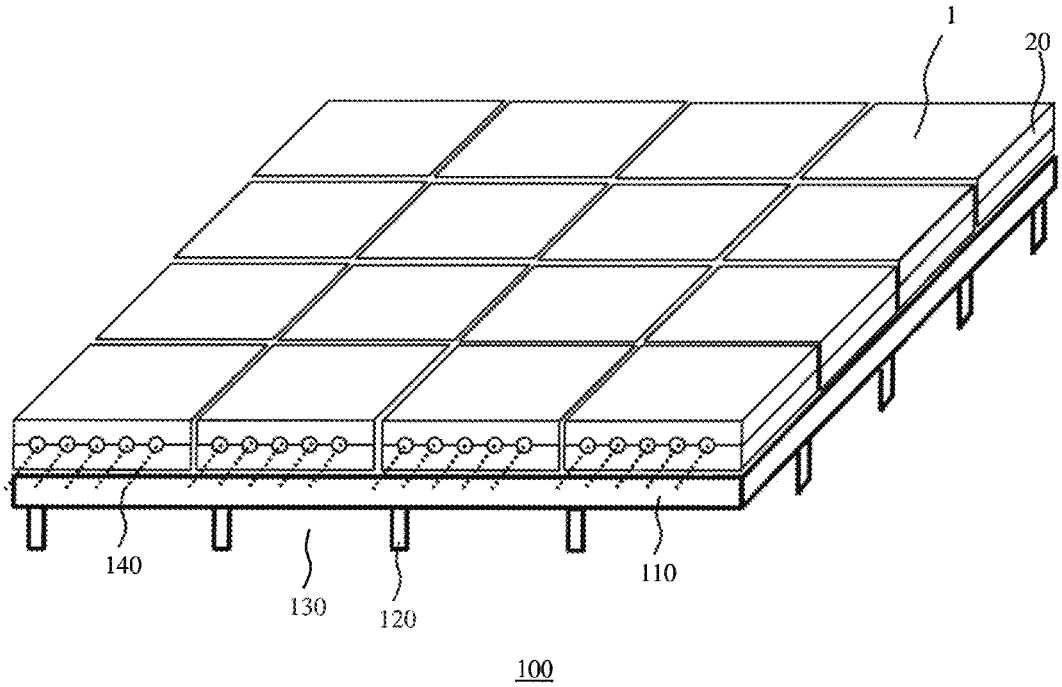
FIG. 7 schematically depicts one embodiment of a portion of a data center floor, according to one or more aspects of the present invention.

FIG. 7 schematically depicts part of a data center floor 100 comprising a grid of floor tiles 1 according to any of the previously described embodiments. The data center floor 100 further comprises a support frame 110, e.g. a grid of support struts or the like defining a grid of floor openings that are dimensioned to receive an individual floor tile 1. The floor tiles 1 may be secured in or on the support frame 110 in any suitable manner. As such support frames are well-known per se, this will not be explained in further detail for the sake of brevity only. It suffices to say that any suitable support frame 110 may be used. In one or more embodiments, the data center floor 100 further comprises legs 120 extending from the support frame 110 for raising the support frame 110 from a surface on which the data center floor 100 is positioned, thereby creating a clearance 130 between this and mounting surface and the support frame 110, which clearance 130 for instance may be used to receive cold air from an air conditioning unit for cooling the servers positioned on the data center floor 100, e.g. through floor tiles 1 comprising air gaps as previously explained.

Figure 8:
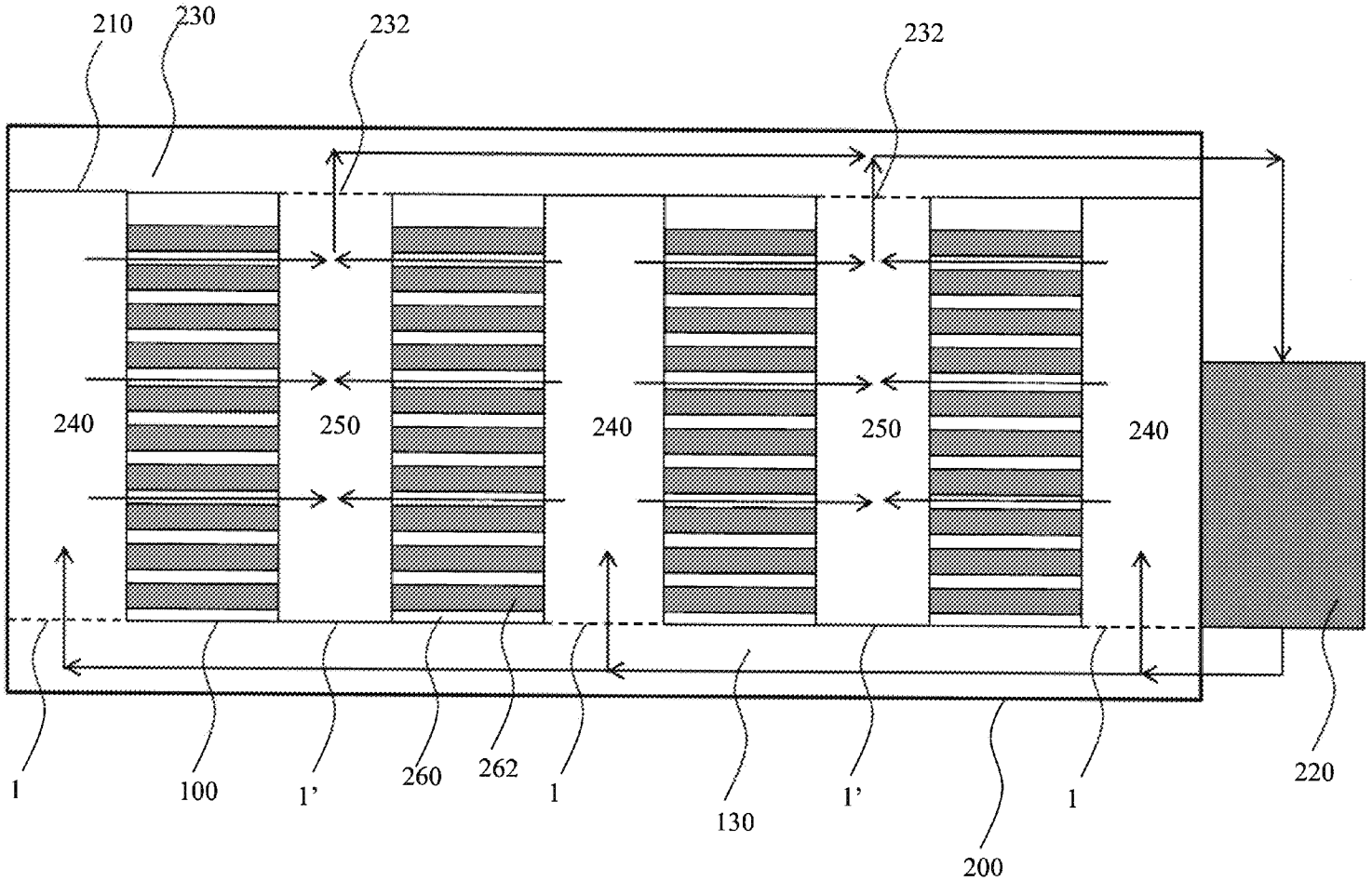
FIG. 8 schematically depicts one embodiment of a data center, according to one or more aspects of the present invention.

FIG. 8 schematically depicts a nova-limiting example of a data center including a data center floor 100 according to an embodiment of the present invention. The data center is placed in a computer room 200 having a raised data center floor 100 and a ceiling 210 such as a suspended ceiling. The clearance 130 between the raised floor 100 and the floor of the computer room 200 may be achieved by placing the data center floor 100 on legs 120 as previously explained. The clearance 130 defines a first conduit and the clearance 230 between the ceiling 210 and the ceiling of the computer room 200 defines a second conduit. The first conduit is used to transport cool air produced by the air conditioning unit 220 to the cold aisles 240 through floor tiles 1 in the raised floor 100. The floor tiles 1 in the cold aisles 240 preferably contain air gaps in the surfaces 21 e.g. have perforated, grid, lattice surfaces 11, 21, or the like. The second conduit is used to transport hot air from the hot aisles 250 through ceiling elements 232 to the air conditioning unit 220 for cooling. The air circulated in this manner is indicated by the solid arrows in FIG. 8. It is noted for the avoidance of doubt that the air conditioning unit 220 may be placed in any suitable location, e.g. inside or outside the computer room 10.

As is known, rows of server racks 260 separate the cold aisles 240 from the hot aisles 250. The server racks typically comprise one or more servers 262 having a front panel facing a cold aisle 240 and a back panel facing a hot aisle 250. Each server 262 typically comprises at least one fan that forces air from the cold aisle 240 through the server 262 towards the hot aisle 250 in order to cool the one or more processing elements and other elements generating heat in the server 262. This is indicated by the solid arrows through the server racks 260.

The hot aisles may also comprise a floor tile 1' that forms part of the raised floor 100. The floor tiles 1' in the hot aisles 250 may also comprise air gaps in surfaces 11, 21 although this is less important for the hot aisles where no cold air needs to be forced through the floor tiles 1 from the clearing 130. In one or more embodiments, floor tiles 1 have air gaps and floor tiles 1' do not have air gaps. Similarly, the ceiling elements 232 in the hot aisles 250 additionally or alternatively may contain air gaps, e.g. perforations, a grid or lattice, or the like, to allow hot air to be transported from the hot aisles 250 to the air conditioning unit 220 via the clearance 230.

Such a data center enjoys improved temperature control, ease of maintenance and health and safety conditions due to the use of the floor tiles 1, 1' in the data center floor 100, as the modular nature of these tiles allows for the removal of the second tile module 20 whilst retaining first tile module 10 in the floor, thereby avoiding tile-sized gaps resulting from the complete removal of a floor tile from the data center floor 100, which gaps can disturb thermal management of the data center and create a health and safety risk.

It is noted for the avoidance of doubt that the implementation of the data center as shown in FIG. 8 is by way of non-limiting example only. The present invention is not limited to a particular data center configuration; any data center employing a data center floor, in particular a raised data center floor, may benefit from the teachings of the present invention.

Those skilled in the art will note from the above description that provided herein is a floor tile for a data center, as well as a data center floor including such a floor tile, and a data center including such a data center floor. As discussed, the floor tile includes, for instance: a first tile module having a main surface including a first side wall portion and a second side wall portion extending from opposite edges of the main surface, the first side wall portion and the second side wall portion each including at least one recess for receiving cabling; and a second tile module having a main further surface adapted to form a removable lid of the first tile module.

While particular embodiments of the present invention have been described herein for purposes of illustration, many modifications and changes will become apparent to those skilled in the art. Accordingly, the appended claims are intended to encompass all such modifications and changes as fall within the true spirit and scope of this invention.

What is claimed is:

1. A floor tile for a data center floor, comprising:

a first tile module comprising a main tile portion with opposite inner and outer main surfaces and a first side wall and a second side wall extending away from the opposite main surfaces to an edge, the first side wall and second side wall being opposing side walls and each sidewall edge comprising at least one recess for receiving cabling, wherein the recesses do not extend to the inner main surface; and a second tile module comprising a further main tile portion adapted to form a removable lid of the first tile module, and having opposite inner and outer further main surfaces with a first further side wall and a second further side wall extending away from the opposite further main surfaces to an edge, the first further side wall and the second further side wall being opposing side walls and each sidewall edge comprising at least one further recess for receiving the cabling, wherein the further recesses do not extend to the inner further main surface; and wherein, with the floor tile in position, the first side wall and the first further side wall align and contact, and the second side wall and the second further side wall align and contact to support the second tile module on the first tile module, and together the at least one recess in each of the first side wall and the second side wall and the least one further recess in each of the first further side wall and the second further side wall define at least one aperture in the aligned first side wall and first further side wall, and at least one further aperture in the aligned second side wall and the second further side wall, the at least one aperture and the at least one further aperture facilitating passing the cabling through the floor tile.

2. The floor tile of claim 1, further comprising a third side wall opposite a fourth side wall, the third side wall and fourth side wall each extending from the first side wall to the second side wall.

3. The floor tile of claim 2, wherein the third side wall and the fourth side wall each comprise at least one further recess for receiving cabling.

4. The floor tile of claim 1, further comprising a fastener to fasten the first tile module to the second tile module.

5. The floor tile of claim 1, wherein the main tile portion and the further main tile portion each comprise a plurality of air holes for passing air through the floor tile.

6. The floor tile of claim 5, wherein the main tile portion and the further main tile portion comprise perforated surfaces.

7. A data center floor comprising a grid of floor tiles including floor tiles having:

a first tile module having a main tile portion with opposite inner and outer main surfaces and a first side wall and a second side wall extending from a main side of the opposite main surfaces to an edge away from the opposite main sides, the first side wall and second side wall being opposing side walls and each sidewall edge comprising at least one recess for receiving cabling, wherein the recesses do not extend to the inner main surface; and a second tile module comprising a further main tile portion, the further main tile portion having opposite inner and outer further main surfaces with a first further side wall and a second further side wall extending away from the opposite further main surfaces to an edge, the first further side wall and the second further side wall being opposing side walls and each sidewall edge comprising at least one further recess for receiving the cabling, wherein the further recesses do not extend to the inner further main surface; and wherein, with the floor tile in position, the first side wall and the first further side wall align and contact, and the second side wall and the second further side wall align and contact to support the second tile module on the first tile module, and together the at least one recess in each of the first side wall and the second side wall and the least one further recess in each of the first further side wall and the second further side wall define at least one aperture in the aligned first side wall and first further side wall, and at least one further aperture in the aligned second side wall and the second further side wall, the at least one aperture and the at least one further aperture facilitating passing the cabling through the floor tile.

8. The data center floor of claim 7, further comprising a plurality of legs for raising the grid of floor tiles above a floor surface on which the legs are to be positioned.

9. A data center including a data center floor comprising a grid of floor tiles including floor tiles having:

a first tile module comprising a main tile portion with opposite inner and outer main surface and a first side wall and a second side wall extending away from the opposite main surfaces to an edge, the first side wall and second side wall being opposing side walls and each sidewall edge comprising at least one recess for receiving cabling, wherein the recesses do not extend to the inner main surface; and a second tile module comprising a further main tile portion, the further main tile portion having opposite inner and outer further main surfaces with a first further side wall and a second further side wall extending away from the opposite further main surfaces to an edge, the first further side wall and the second further side wall being opposing side walls and each sidewall edge comprising at least one further recess for receiving the cabling, wherein the further recesses do not extend to the inner further main surface; and wherein, with the floor tile in position, the first side wall and the first further side wall align and contact, and the second side wall and the second further side wall align and contact to support the second tile module on the first tile module, and together the at least one recess in each of the first side wall and the second side wall and the least one further recess in each of the first further side wall and the second further side wall define at least one aperture in the aligned first side wall and first further side wall, and at least one further aperture in the aligned second side wall and the second further side wall, the at least one aperture and the at least one further aperture facilitating passing the cabling through the floor tile.

10. The data center of claim 9, further comprising a plurality of legs mounted on the grid of floor tiles, the legs raising the grid of floor tiles above a floor surface of the data center on which the legs are placed.

11. The data center of claim 9, further comprising a third side wall opposite a fourth side wall, the third side wall and fourth side wall each extending from the first side wall to the second side wall.

12. The data center of claim 11, wherein the third side wall and the fourth side wall each comprise at least one further recess for receiving cabling.

* * * * *